United States Patent [19]

Beer

[11] Patent Number: 4,952,178

[45] Date of Patent: Aug. 28, 1990

[54] FEMALE ELECTRICAL CONNECTOR

[75] Inventor: Dieter Beer, Moesbach/Feldkahl, Fed. Rep. of Germany

[73] Assignee: C-A-Weidmueller GmbH & Co., Detmold, Fed. Rep. of Germany

[21] Appl. No.: 380,469

[22] Filed: Jul. 17, 1989

[30] Foreign Application Priority Data

Aug. 5, 1988 [EP] European Pat. Off. ..... 88-112-759.1

[51] Int. Cl.[5] ..... H01R 11/22

[52] U.S. Cl. ..... 439/856; 439/842

[58] Field of Search ..... 439/851-858, 439/842

[56] References Cited

U.S. PATENT DOCUMENTS

| | | | |
|---|---|---|---|
| 4,032,215 | 6/1977 | Jarmofsky et al. | 439/852 |
| 4,076,369 | 2/1978 | Ostapovitch | 439/852 |
| 4,232,931 | 11/1980 | Takeuchi et al. | 439/857 |

FOREIGN PATENT DOCUMENTS

| | | | |
|---|---|---|---|
| 0060024 | 9/1982 | European Pat. Off. | 439/853 |
| 0123383 | 10/1984 | European Pat. Off. . | |
| 2529023 | 12/1983 | France | 439/851 |

OTHER PUBLICATIONS

"Straight-Through Connection", IBM Tech. Disclosure Bulletin, vol. 13, No. 11, Apr. 1971, pp. 3341-3342.

*Primary Examiner*—David L. Pirlot

*Attorney, Agent, or Firm*—Laubscher, Presta & Laubscher

[57] ABSTRACT

A hollow generally tubular female electrical connector is formed from a sheet metal blank to define a body member having a rectangular cross-sectional configuration including opposed pairs of side walls, characterized by the formation of two pairs of opposed inwardly-extending contact tongues that are arranged in longitudinally spaced relation for successive engagement by a male connector, whereby two different longitudinally-spaced contact planes are provided to afford reliable safe electrical contact with the male connector. Preferably, the contact tongues of one pair are formed from body side walls that are orthogonally arranged relative to the side walls from which the other pair of contact tongues are formed, whereby the pairs of contact tongues are arranged at 90° relative to each other.

7 Claims, 1 Drawing Sheet

FIG. 1
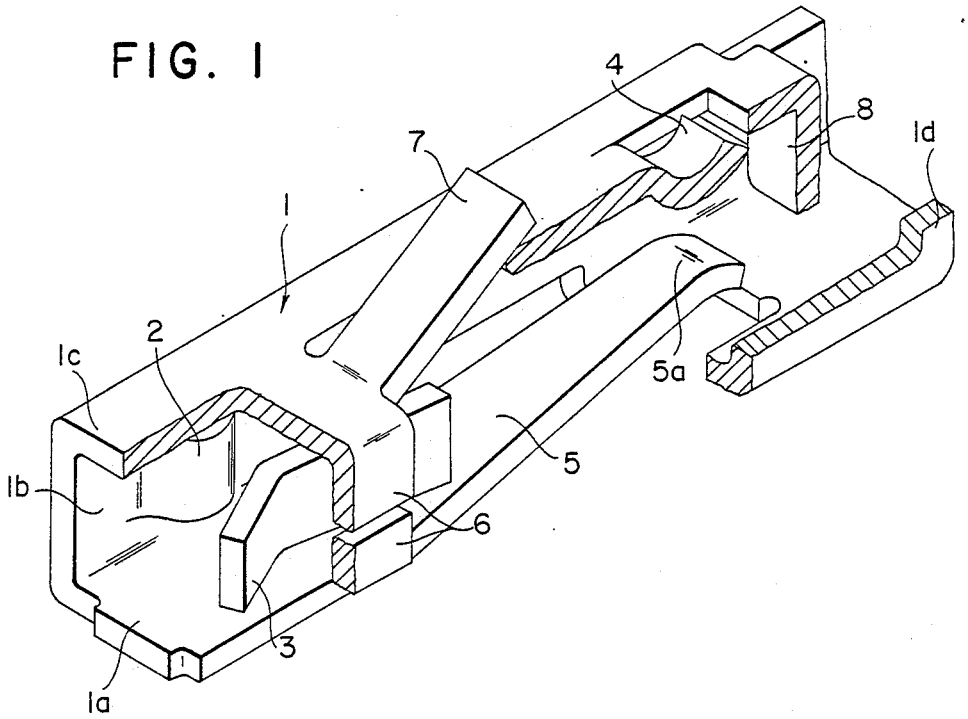
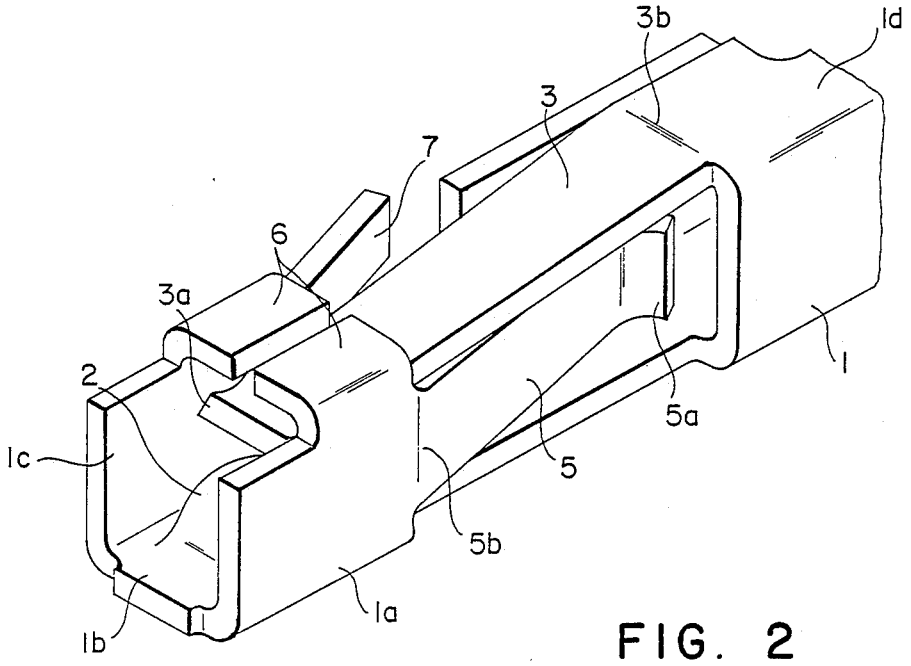
FIG. 2

FEMALE ELECTRICAL CONNECTOR

BRIEF DESCRIPTION OF THE PRIOR ART

This invention relates to a hollow, generally-connector tubular female electrical formed from a sheet metal blank to define a body member having a generally rectangular cross-section including two pairs of opposed side walls, and two pairs of opposed inwardly-directed contact tongues formed from said side walls in longitudinally spaced relation, respectively, whereby said contact tongue pairs may be safely and reliably connected with corresponding contacts on a male electrical connector.

It is known in the prior art to provide such box-like female electrical connectors formed by folding, stamping and/or punching sheet metal blanks, which connectors generally include a pair of opposed contact tongues one of which is normally rigid, and the other of which is resilient. Furthermore, in the European patent application No. EP-Al-0123383, it is known to provide such a female connector with two pairs of opposed contact tongues arranged in a common contact plane. Such an arrangement, as compared with female connectors having only two opposed contacts, often results in a decrease in contact reliability since it is quite difficult to place the contacts with accuracy adjacent one end of the connector body, so that the problem remains of effecting satisfactory electrical contact with a male connector having relatively short pins. Finally, the male member is subjected to the undesirably high frictional force produced by four circumferentially-arranged contacts during insertion of the male connector to its final position.

The present invention was developed to produce a female electrical connector which avoids the drawbacks of the prior art and which affords a particularly high contact reliability together with relatively easy connection and disconnection of the male and female electrical connectors.

SUMMARY OF THE INVENTION

Accordingly, a primary object of the present invention is to provide an electrical connector of hollow, generally-tubular construction formed from a sheet metal blank to define a body member having a generally rectangular cross-sectional configuration and including two pairs of opposed side walls, said body member having two pairs of opposed inwardly-directed contact tongues arranged on said side walls in longitudinally-spaced relation for successive engagement by an associated male connector, respectively. Thus, two longitudinally spaced contact planes are defined on the female connector, thereby resulting in good contact reliability and an improved gripping of the male connector within the female connector, particularly with respect to vibration stresses imparted to the plug. In this improved design, it is furthermore possible, according to a preferred embodiment, to arrange the forward contact element pair immediately adjacent the forward end of the female connector. Consequently, the female connector is suitable for use with a male connector having extremely short guide pins which will still be effectively contacted by only two contact tongues.

In this connection, a further advantage of the invention is the relatively low traction force required for contact engagement when viewed in the light of the entire insertion length of the plug. This force is progressively increased as a consequence of the longitudinal spacing between the two contact planes. To that end, it is necessary to overcome only the force exerted by all four contact elements for the relatively short pushing distance between the rear contact plane and the final insertion position. This advantage is all the more important in multiple plug connectors, such as one having as many as 50 contacts that are engaged during a single plug-in operation.

In accordance with a more specific object of the invention, the tongues of the rear contact pair are formed from one opposed pair of side walls, and the tongues of the forward contact pair are formed from the other opposed pair of side walls, whereby the pairs of opposed contact tongues are arranged at 90° relative to each other. This results in increased contact safety and reliability. Since the undesirable reduction of the contact area resulting from an improper oblique insertion of the male member and/or from vibration stresses takes place only in one direction or in the opposite direction, at least one contact tongue pair remains completely operable. Finally, the 90° displacement of the pairs of contacts produces a structurally simplified design of the sheet metal blank, thereby simplifying production of the female electrical connector.

BRIEF DESCRIPTION OF THE DRAWING

Other objects and advantages of the invention will become apparent from a study of the following specification when viewed in the light of the accompanying drawing in which:

FIG. 1 is a front perspective view, with certain parts broken away for clarity, of the female electrical connector of the present invention; and FIG. 2 is a similar perspective view of the electrical connector when rotated through 90°.

DETAILED DESCRIPTION

Referring first more particularly to FIG. 1, the female electrical connector 1 is formed by folding, stamping and/or punching a sheet metal blank into a box-like generally tubular body member having a generally rectangular cross-sectional configuration, said body member including opposed pairs of side walls 1*a*, 1*c* and 1*b*, 1*d*, respectively. At the forward end of the female connector, a relatively short rigid contact tongue 2 is formed inwardly from the side wall 1*b* and a relatively long resilient inwardly directed contact tongue 3 is formed from the opposite side wall 1*d*, said contact tongues having opposed effective contact surfaces adjacent the forward end of the female connector. At its rearward end, the female electrical connector includes a relatively short rigid rear contact 4 that is formed from the body wall 1*c*, and an opposed inwardly directed relatively long resilient contact tongue 5 that is formed from the opposite side wall 1*a*. Thus, the pairs of opposed contact tongues 2, 3, and 4, 5 include longitudinally spaced effective contact surfaces, which pairs of contact tongues are arranged at 90° relative to each other. Preferably, the inwardly directed contact tongues are formed by stamping from the respective side wall portions of the female electrical connector. Since the resilient contact tongues 3 and 5 extend in opposite directions relative to the female electrical connector, it is possible to keep the punching and/or pressing operation of the blank relatively simple, and thereby affording the further advantage of protecting the free ends of the oppositely-arranged longitudinally extending resilient contact tongues 3 and 5, respectively. More particularly, the side walls 1*a* and 1*c* are provided with inwardly bent wing portions 6 that protect the free end 3*a* of the forwardly extending resilient tongue member 3. To this end, the length of the resilient tongue member 3 is such that the free end thereof 3*a* extends beyond the fold line 5*b* of the associated resilient tongue 5, and the end extremity 5*a* of the resilient tongue 5 extends rearwardly short of the fold line 3*b* of the associated resilient contact tongue 3, whereby the end portion 5*a* is also protected within the hollow female connector beneath the resilient tongue 3.

In accordance with a further feature of the invention, there is formed from the side wall 1*c* an outwardly bent stop projection 7 which serves to limit the extent of insertion of the female electrical connector within a switchboard housing (not shown). Furthermore, an inwardly extending stop tab 8 is provided at the rear end of the female connector for limiting the extent of insertion of the associated male connector within the female connector.

In accordance with a further important advantage of the invention, the end portion 3*a*, of the resilient contact tongue 3 and the opposed inwardly extending tongue portion 2 are immediately adjacent the forward end of the female connector, thereby permitting use of a male connector of relatively short length. For example, the female connector may be used with a male connector having a pin length of about 2.5 mm or less, as distinguished from a customary pin length of about 5.8 mm. In this numerical example, the foward contact plane defined by the effective contact surfaces of the contact tongues 2 and 3 is spaced about 1.7 mm from the forward edge of the connector, while the rearward contact plane defined by the effective contact surfaces of the tongues 4 and 5 lies about 3.8 mm behind the first contact plane.

The rearmost extremity of the female connector extends beyond the stop tab 8, thereby permitting electrical connection —for example by a crimping connection or a cutting connection —with associated electrical equipment, such as an electrical conductor heater, by means of a conventional connecting technique.

Of course, it is possible to form each of the four contact tongues as a resilient member, or alternatively, only two of the associated contact tongues may comprise resilient members, the other two contact tongues being rigid members. In the context of the present invention, one can employ various combinations of resilient and relatively rigid contact tongues. Furthermore, the outwardly bent stop projection 7 can be replaced by another customary stop device. Furthermore, the relatively rigid contact tongues may be replaced with a relatively more resilient contact tongue. If the forward contact element pair 2 and 3 is formed by two resilient contact arms, these arms would extend to protectively cover the free end portions 5*a* of the rearwardly extending contact tongues.

Other changes may be made without deviating from the inventive concepts set forth above.

What is claimed is:

1. A female electrical connector adapted to receive a male electrical connector, comprising:

(a) a hollow generally tubular connector body member (1) formed from a sheet metal blank, said body member having a generally rectangular cross-section and including pairs of opposed side walls (1*a*, 1*c*; 1*b*, 1*d*); and (b) first (2, 3) and second (4, 5) pairs of opposed contact tongues formed from said body side walls, respectively each of said contact tongues extending at one end inwardly within said body member, the contact tongues of said first pair being formed from said first pair of side walls, respectively, and the contact tongues of said second pair being formed from said second pair of side walls, respectively, whereby said pairs of contact tongues are displaced 90° relative to each other;

(c) said first and second pairs of contact tongues extending longitudinally in opposite directions from opposite ends of said body member, said pairs of contact tongues being arranged to define longitudinally spaced effective contact surfaces relative to said body member, respectively;

(d) one contact tongue of each pair being relatively short and rigid, and the other contact tongue of that pair being relatively long and flexible.

2. Apparatus as defined in claim 1 wherein said contact tongues are formed by stamping from the metal sheet.

3. Apparatus as defined in claim 1, wherein said first pair of contact tongues (2, 3) have effective contact surfaces immediately adjacent one end of said body member.

4. Apparatus as defined in claim 3, wherein said body member one end comprises a forward end for receiving the male connector, and further including at the other end of said body member an inwardly directed stop tab (8) formed from one of said walls for limiting the extent of introduction of the male connector.

5. Apparatus as defined in claim 1, wherein said longer tongue (3 of one pair extends longitudinally of said body member beyond the point of connection (5*a*) of the longer tongue (5) of the other pair with its associated side wall.

6. Apparatus as defined in claim 5, wherein said second tongue (5) terminates at its free end intermediate the ends of said first tongue.

7. A female electrical connector adapted to receive a male electrical connector, comprising:

(a) a hollow generally tubular connector body member (1) formed from a sheet metal blank, said body member having a generally rectangular cross-section and including pairs of opposed side walls (1*a*, 1*c*; 1*b*, 1*d*);

(b) first (2, 3) and second (4, 5) pairs of opposed contact tongues formed from said body side walls, respectively, each of said contact tongues extending at one end inwardly within said body member, the contact tongues of said first pair being formed from said first pair of body side walls, respectively, and the contact tongues of said second pair being formed from said second pair of side walls, respectively, whereby said pairs of contact tongues are displaced 90° relative to each other;

(c) said first and second pairs of contact tongues extending longitudinally in opposite directions from opposite ends of said body member, thereby no cause said pairs of contact tongues to have longitudinally spaced effective contact surfaces relative to said body member, respectively;

(d) one contact tongue of each pair being relatively short and rigid, and the other contact tongue of that pair being relatively long and flexible, said longer tongue (3) of one pair extending longitudinally of said body member beyond the point of connection (*5l*) of the longer tongue (5) of the other pair with its associated side wall; and (e) protective wing means (6) formed from the side walls (*1a*, *1d*) from which said other pair of contacts is formed and extending orthogonally in protective relation above the free extremity (*3a*) of the longer tongue (3) of said one contact pair.

* * * * *